US005571983A

United States Patent [19]

Yamaguchi et al.

[11] Patent Number: 5,571,983

[45] Date of Patent: Nov. 5, 1996

[54] ABUTMENT DEVICE FOR A KEY SWITCH ARRANGEMENT OPERABLE WITH BOTH HAMMER-EQUIPPED AND HAMMERLESS KEYBOARDS FOR ELECTRONIC MUSICAL INSTRUMENTS

[75] Inventors: Tsutomu Yamaguchi; Kazuhiro Tsukamoto, both of Shizuoka-ken, Japan

[73] Assignee: Kabushiki Kaisha Kawai Gakki Seisakusho, Shizuoka-ken, Japan

[21] Appl. No.: 152,706

[22] Filed: Nov. 16, 1993

[30] Foreign Application Priority Data

Nov. 17, 1992 [JP] Japan ..... 4-085220 U

[51] Int. Cl.[6] ..... G10H 1/34; G10H 3/00

[52] U.S. Cl. ..... 84/745; 84/433; 84/DIG. 7

[58] Field of Search ..... 84/743–745, 423 R, 84/433, DIG. 7

[56] References Cited

U.S. PATENT DOCUMENTS

| | | | |
|---|---|---|---|
| 5,062,342 | 11/1991 | Nagatsuma | 84/744 |
| 5,243,125 | 9/1993 | Yamaguchi | 84/745 |
| 5,249,497 | 10/1993 | Niitsuma . | |
| 5,406,875 | 4/1995 | Tamai et al. . | |

*Primary Examiner*—Jonathan Wysocki
*Assistant Examiner*—Jeffrey W. Donels
*Attorney, Agent, or Firm*—Evenson, McKeown, Edwards & Lenahan, P.L.L.C.

[57] ABSTRACT

A keyboard device for an electronic musical instrument comprises a keyboard chassis, keys rotatively arranged on the keyboard chassis, and a key switch arranged beneath each of the keys for detecting a key status of each key. Each key has a switch-depressing projection arranged just above the key switch, and a hammer-depressing projection for depressing a hammer when the hammer is provided, with the switch-depressing projection and the hammer-depressing projection being formed adjacent to each other in one piece.

11 Claims, 6 Drawing Sheets

ABUTMENT DEVICE FOR A KEY SWITCH ARRANGEMENT OPERABLE WITH BOTH HAMMER-EQUIPPED AND HAMMERLESS KEYBOARDS FOR ELECTRONIC MUSICAL INSTRUMENTS

BACKGROUND OF THE INVENTION

1. Field of the Invention

This invention relates to a keyboard device for an electronic musical instrument, such as an electronic piano and an electronic organ.

2. Prior Art

In general, a keyboard device for an electronic musical instrument includes a key switch arranged beneath each key thereof for detecting depression of the key. The electronic musical instrument produces a musical tone based on results of detection of the keys status of each key by the key switch associated therewith. Further, the keyboard device is classified into a hammer type having a hammer associated with each key for being swung thereby to make the sense of a touch on the key similar to that obtained from an acoustic piano, and a hammerless type having no such hammers.

Of the two types of keyboard device, the hammer type is disclosed e.g. by Japanese Provisional Patent Publication (Kokai) No. 2-149893. The proposed hammer-type keyboard device is provided with keys each having a rear portion thereof supported on a pivot for rotation thereabout, and a switch-depressing projection formed on a lower side surface thereof for depressing a key switch provided at a location away from the pivot by approximately half the length of the key. Further, this keyboard device includes a keyboard chassis having key switches each formed by a rubber switch and located just beneath a corresponding switch-depressing projection for being directly depressed by the switch-depressing projection when a player depresses a key corresponding thereto. On the other hand, hammers are each rotatively supported on pivots other than those for the keys. Each of the hammers has a projection formed thereon on the side forward of its pivot at a location away from the pivot of the corresponding key by approximately one third of the length of the key, for abutting on the lower side surface of the key. As the key is depressed, the hammer is directly driven by the key into swinging motion around its pivot.

However, the conventional keyboard device has room for improvement in respect of the following points:

First, in spite of provision of hammers, the keyboard device cannot offer the sense of a touch on each key which is sufficiently similar to that obtained from an acoustic piano. This is because unlike the acoustic piano in which each hammer strikes a string to produce a musical tone, the conventional keyboard device for the electronic musical instrument has the switch-depressing projection provided for directly operating the key switch, that is, the conventional keyboard device is not constructed such that a musical tone is produced according to motion of each hammer, which sets a limit to realization of the sense of a key touch close to that obtained from the acoustic piano.

Secondly, if the conventional keyboard device is to be manufactured while permitting the common modifications of a hammer type and a hammerless type, the location of the key switch thereof is required to be shifted in a forward or backward direction depending on the type of the keyboard device. As already mentioned above, it is preferred for the hammer type that the key switch is operated by way of the hammer for the purpose of making the sense of a key touch closer to that obtained from the acoustic piano. On the other hand, in the conventional keyboard device, the hammer is arranged at a location fairly backward of the key switch, so that it is required to rearrange the key switch at a location suitable for receiving action of the hammer, if the key switch is to be operated by way of the hammer. Such a shift of the location of the key switch in a forward or backward direction between the hammer-type keyboard device and the hammerless-type keyboard device prevents compatibility of a key switch and fixture means thereof for one type of the keyboard device with those for the other type, which in turn prevents reduction of manufacturing cost thereof. Further, when the key is depressed, the resilient force of the key switch acts on the key as a reaction force, so that if the key switch is shifted to a forward or backward location depending on whether or not the hammer is provided, the characteristic of depressing load of the key is largely changed.

Further, in the conventional keyboard device, the hammer is provided with a projection which directly abuts on the lower side surface of the key, for being depressed thereby. This makes the configuration of a contact surface of the hammer complicated, resulting in inconveniences, such as limitation of the kind of cushion material normally attached to the contact surface of the hammer.

SUMMARY OF THE INVENTION

It is the object of the invention to provide a keyboard device for an electronic musical instrument which can be manufactured in a manner permitting the common modifications of both a hammer type and a hammerless type without requiring displacement of a key switch in a forward or backward direction, and offers an excellent sense of a key touch when it is formed as the hammer type, while enabling configuration of the hammer to be simplified.

To attain the above object, the present invention provides a keyboard device for an electronic musical instrument including a keyboard chassis, a plurality of keys rotatively arranged on the keyboard chassis, and a key switch arranged beneath each of the keys for detecting a key status of the each of the keys.

The keyboard device according to the invention is characterized in that the each of the keys comprises a switch-depressing projection arranged just above the key switch for depressing the key switch when the keyboard into device is not provided with a hammer for the each of the keys, and a hammer-depressing projection for depressing the hammer for the each of the keys when the keyboard device is provided therewith, the switch-depressing projection and the hammer-depressing projection being formed adjacent to each other in one piece.

According to this keyboard device, in the case of the hammerless type, when the key is depressed, the switch-depressing projection arranged just above the key switch directly depresses the key switch to operate same, whereas in the case of the hammer type, the hammer-depressing projection depresses the hammer, which in turn depresses the key switch, making it possible to operate same by way of the hammer depressed. Since the switch-depressing projection and the hammer-depressing projection are formed adjacent to each other, and hence the hammer can be depressed at a point very close to the switch-depressing projection, i.e. at a point very close to the key switch, it is not required to shift the location of the key switch depending on whether the hammer is provided or not. Further, since the hammer-depressing projection depresses the hammer, the abutment of the hammer on which the hammer-depressing projection abuts can be formed in a simple configuration, e.g. as one having a flat surface. Further, since the two projections are formed in one piece, they reinforce with each other to increase the strength of each of them.

In a preferred form of the invention, the keyboard device includes the hammer rotatively arranged in the keyboard chassis in a manner corresponding to the each of the keys, and the hammer has an abutment member for abutting on the hammer-depressing projection of the each of the keys, and a switch-depressing portion arranged such that the switch-depressing portion faces the key switch.

According to this preferred embodiment, if the keyboard device is of the hammer type, when the key is depressed, the hammer-depressing projection of the key depresses the hammer by the abutment member of the hammer, and the switch-depressing portion of the hammer depresses the key switch to operate same. Therefore, it is possible to reliably and positively operate the key switch by way of the hammer, without shifting the location of the key switch in a longitudinal direction, i.e. forward or backward.

Preferably, the keyboard device includes a spring for the hammer, and the abutment member of the hammer has first spring-holding means for holding one end of the spring, the hammer being urged in a predetermined direction such that the abutment member of the hammer abuts on the hammer-depressing projection of the key to urge the key in the predetermined direction.

More preferably, the keyboard device includes a shaft provided for the hammer to cause the hammer to rotate about the axis thereof, and shaft support means fixed to the keyboard chassis for supporting the shaft, the shaft support means having second spring-holding means for holding the other end of the spring.

Further preferably, the hammer has the abutment member formed on one end portion thereof, and a hammer weight provided on the other end portion thereof.

The above and other objects, features, and advantages of the invention will become more apparent from the following detailed description taken in conjunction with the accompanying drawings.

DETAILED DESCRIPTION

The invention will now be described in detail with reference to the drawings showing preferred embodiments thereof.

Figure 1:
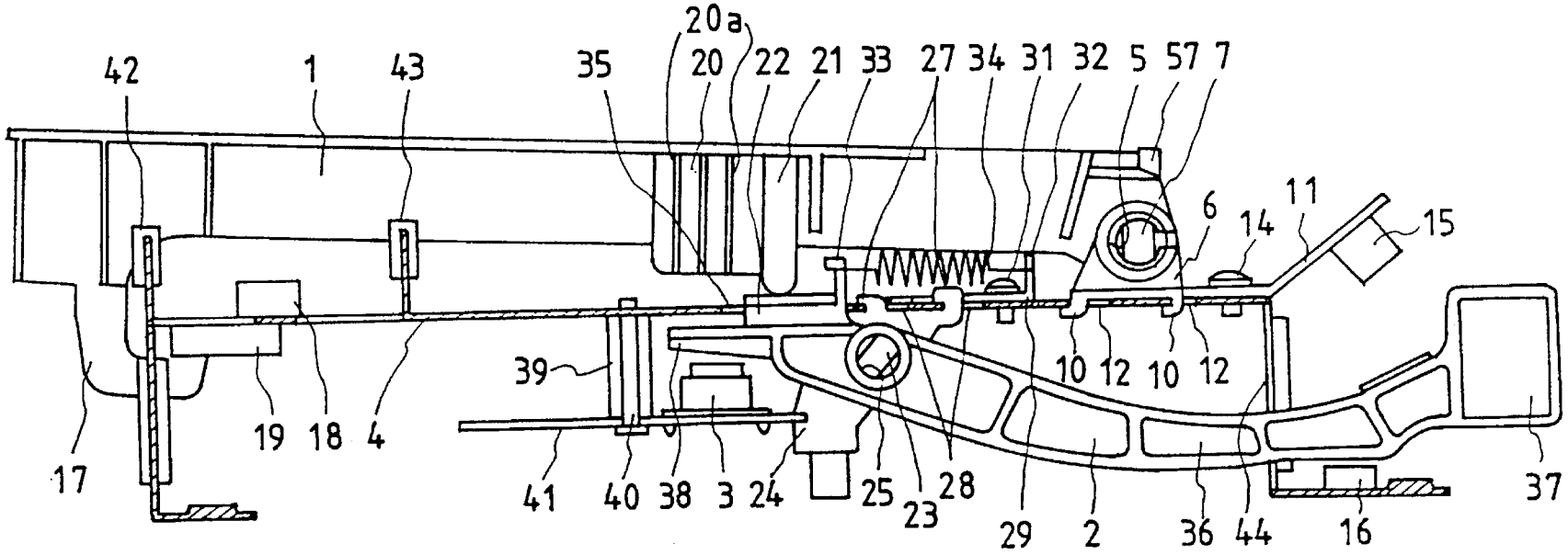
FIG. 1 is a cross-sectional view showing a unit part of a hammer type, in its key-released state, of a keyboard device according to a first embodiment of the invention.
Figure 2:
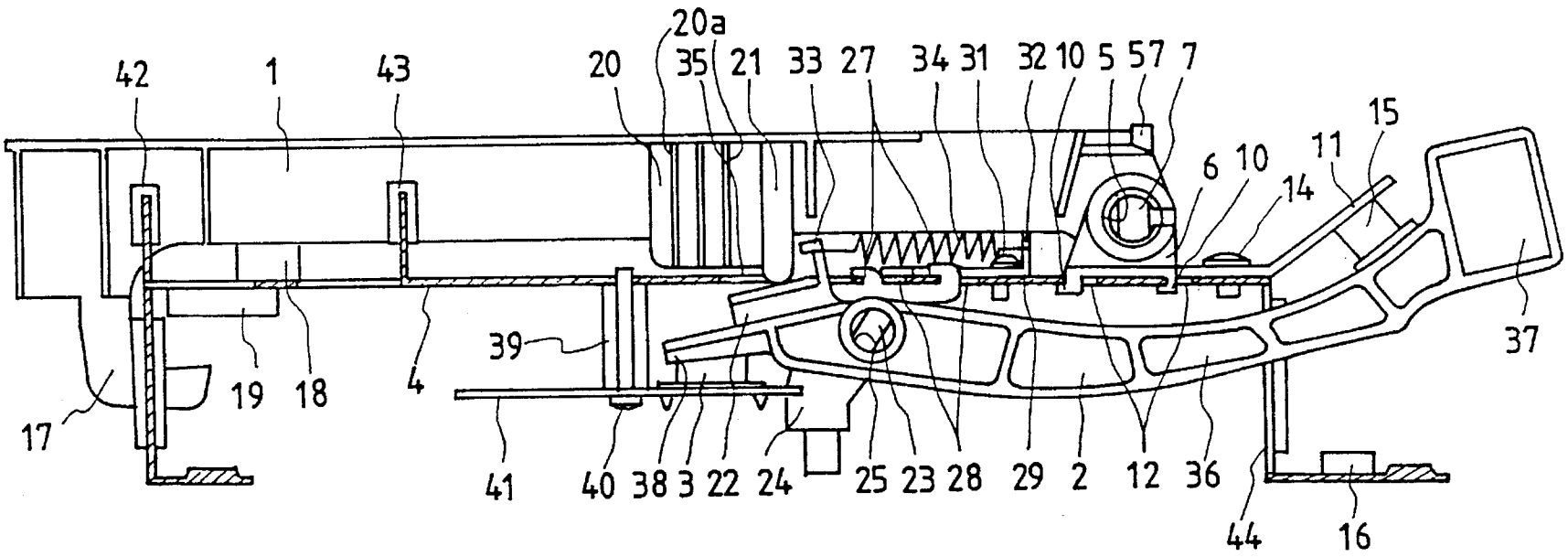
FIG. 2 is a cross-sectional view showing the unit part of the hammer-type keyboard device of FIG. 1, in its key-depressed state.

FIG. 1 and FIG. 2 show a unit part of a hammer-type keyboard device according to a first embodiment of the invention, in its key-released state and key-depressed state, respectively. As is apparent from these figures, the unit part of the keyboard device comprises a key 1, a hammer 2 cooperatively associated with the key 1 for being swung thereby, a key switch 3 for detecting a key status of the key 1, and a keyboard chassis 4 on which these component parts are mounted.

Figure 3A:
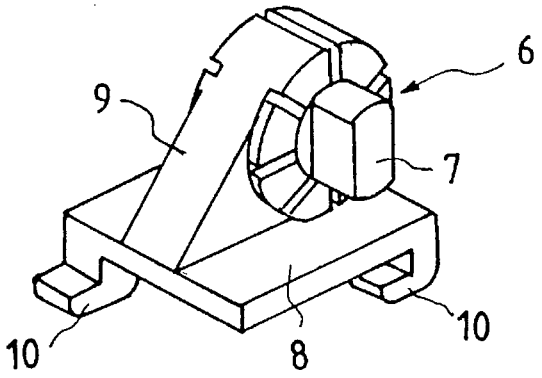
FIG. 3*a* is a perspective view showing a configuration of a key support member.

The key 1 has a through hole 5 formed through a rear end portion (right end portion as viewed in FIG. 1 and FIG. 2) thereof for receiving a shaft 7 of a key support member 6 mounted on the upper side of the keyboard chassis 4, whereby the key 1 is rotatively supported on the key support member 6. As shown in FIG. 3*a*, the key support member 6 is formed, in one piece, by a base portion 8 having a rectangular shape, a supporting projection 9 which projects upward from a central part of the base portion 8, the shaft 7 formed by portions laterally projected from opposite sides of the supporting projection 9, and two hooks 10, 10 diagonally located on the lower side of the base portion 8 at front and rear end locations.

Figure 3B:
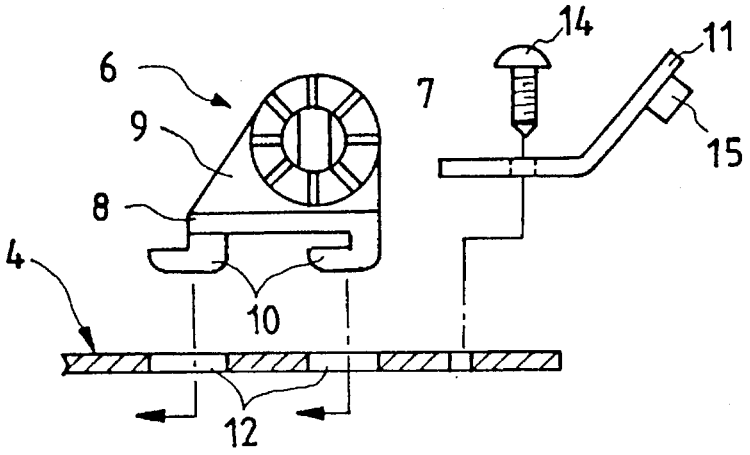
FIG. 3*b* is a side view showing the key support member, part of a keyboard chassis in cross-section, and associated locking means, which is useful in explaining how the key support member shown in FIG. 3*a* is rigidly mounted on the keyboard chassis.
Figure 3C:
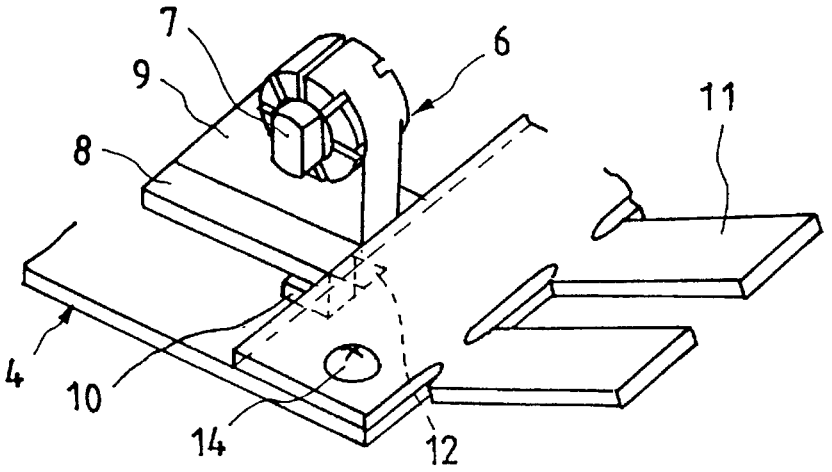
FIG. 3*c* is a perspective view showing the key support member appearing in FIG. 3*a* in its rigidly-mounted state.

As can be understood from FIG. 3*b* and FIG. 3*c*, the key support member 6 is fixed to the keyboard chassis 4 by a locking plate 11 in the following manner: The hooks 10, 10 of the key support member 6 are inserted from above two corresponding holes 12, 12 formed through the keyboard chassis 4, and then the key support member 6 is slid forward to hook the keyboard chassis 4. Then, the locking plate 11 is fixed on the keyboard chassis 4 by screws 14, such that the locking plate 11 is pressed against the rear end face of the key support member 6 to block the remaining opening of the rear-positioned one of the holes 12, 12. Thus, the key support member 6 is firmly mounted on the keyboard chassis 4.

The locking plate 11 has upwardly-inclined rear portions which extend from a portion of the locking plate 11 corresponding to the rear end face of the keyboard chassis 4 when the locking plate 11 is fitted on the keyboard chassis 4. These rear portions of the locking plate 11 each have a hammer stopper 15 formed on the lower side thereof for setting a limit to the uppermost position of the hammer 2. In other words, the locking plate 11 rigidly fixes the key support member 6 to the keyboard chassis 4 such that the former is prevented from removing from the latter, and also serves as a stopper of hammer 2. On the other hand, as shown in FIG. 1, the lowermost position of the hammer 2 is restricted by a stopper 16 formed on the bottom of the keyboard chassis 4. Further, the key 1 is formed with a stopper 17 in a hooked form, on a lower side of a front end (left end portion as viewed in FIG. 1 and FIG. 2). The keyboard chassis 4 has a front end portion formed, on an upper side and a lower side thereof, with a lowermost position-restricting stopper 18 and an uppermost position-restricting stopper 19 for setting limits to the lowermost position and uppermost position of the key 1, respectively.

The key 1 is provided with a switch-depressing projection 20 and a hammer-depressing projection 21, both projecting downward from the key 1 and formed in one piece with each other, with the former in the front position, at a location away from the rear end of the key 1 by approximately half the length of the key 1. The switch-depressing projection 20 has a plurality of fins 20*a* laterally projected from opposite sides thereof. The switch-depressing projection 20 is provided for operating the key switch 3, as described hereinafter with reference to FIG. 5 and FIG. 6, when the keyboard device is of the hammerless type. When the keyboard device is of the hammer type shown in FIG. 1 and FIG. 2, the switch-depressing projection 20 serves an reinforcement member for the hammer-depressing projection 21. The hammer-depressing projection 21 is in the form of a pin extending downward to an extent lower than the lowermost end of the switch-depressing projection 20, with its lower end abutting on an upper surface of an abutment 22 formed on the hammer 2.

Figure 4B:
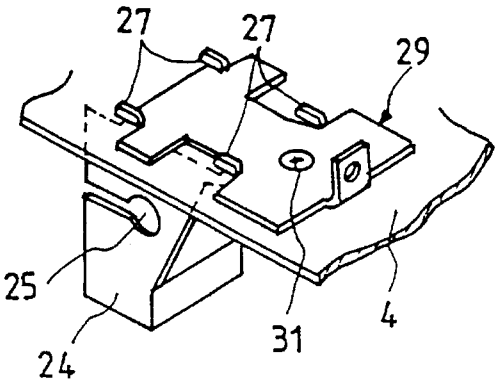
FIG. 4*b* is a perspective view showing the hammer shaft support member appearing in FIG. 4*a* in its rigidly-mounted state.
Figure 4A:
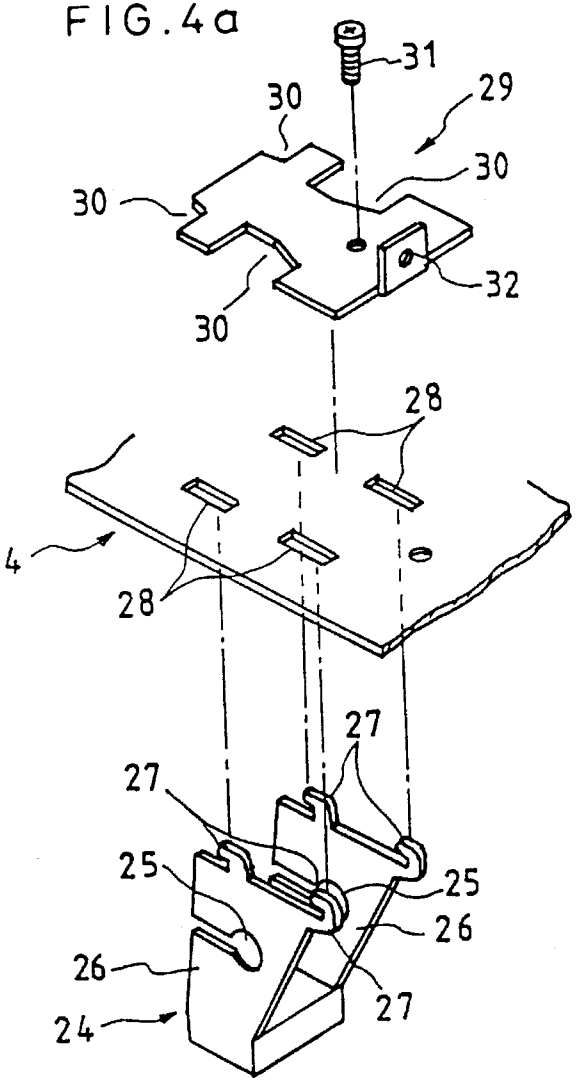
FIG. 4*a* is an exploded perspective view showing a configuration of a hammer shaft support member, part of the keyboard chassis, and associated locking means, which is useful in explaining how the hammer shaft support member is rigidly mounted on the keyboard chassis.

The hammer 2 is arranged on the lower side of the keyboard chassis 4, and has a shaft 23 thereof fitted in shaft holes 25, 25 formed in a hammer shaft support member 24 which is rigidly fixed to the keyboard chassis 4, whereby the hammer 2 is rotatively supported by the hammer shaft support member 24. The hammer shaft support member 24 comprises, as shown in FIG. 4*a*, a pair of support plates 26, 26 extending upward in parallel from opposite ends of a connecting portion, with the shaft holes 25 formed approximately in respective central portions of the support plates 26, 26, and two pairs of hooks 27, 27 formed on the tops of the support plates 26, 26.

The hammer shaft support member 24 is rigidly mounted on the keyboard chassis 4 in the following manner (see FIG. 4*b*): The hooks 27 of the hammer shaft support member 24 are each inserted from below into corresponding four holes 28 formed through the keyboard chassis 4, and then the hammer shaft support member 24 is slid forward to hook the keyboard chassis 4. Then, a locking plate 29 is placed on the keyboard chassis 4, and four urging portions 30 of the locking plate 29 are pressed respectively against the hooks 27 of the hammer shaft support member 24 in a horizontal direction. In the resulting state where the holes 28 are blocked, the locking plate 29 is rigidly fixed to the keyboard chassis 4 by a screw 31.

The locking plate 29 has a portion extending upright from a rear end thereof, which is formed with a spring-holding hole 32, while the hammer 2 has a spring-catching hook 33 projected upward from a rear end of the abutment 22 (see FIG. 1). A position-recovering spring 34 is stretched between the spring-holding hole 32 and the spring-catching hook 33 to urge the hammer 2 in a clockwise direction as viewed in FIG. 1 and FIG. 2. That is, the locking plate 29 serves both as means for rigidly fixing the hammer shaft support member 24 to the keyboard chassis 4 and as means for holding one end of the position-recovering spring 34.

The abutment 22 of the hammer 2 is formed at a location forward of the shaft 23, and is permitted to move up and down through a hole 35 formed through the keyboard chassis 4. The hammer 2 has an arm 36 extending backward in curvature from the shaft 23, and a hammer weight 37 formed in one piece with a rear end portion thereof. The hammer 2 also has a switch-depressing portion 38 formed such that the switch-depressing portion 38 projects forward from below a front end of the abutment 22. The key switch 3 is arranged below the switch-depressing portion 38 in facing relation thereto such that they are spaced by a predetermined distance when the key 1 is not depressed.

The key switch 3 is formed by a rubber switch constructed such that it closes or turns on at each of two different positions of the key 1 to which the key 1 is depressed. The key switch 3 is mounted on an upper surface of a switch printed-circuit board 41 which is fixed to the keyboard chassis 4 by a screw 40 with a spacer 39 interposed therebetween. The key switch 3 delivers an ON/OFF signal to a tone-generating system, not shown. The switch printed-circuit board 41 has a peripheral portion thereof held by the hammer shaft support member 24. In addition, reference numerals 42, 43 in FIG. 1 and FIG. 2 designate guides for preventing a swaying motion of the key 1, respectively, and reference numeral 44 a guide for preventing a swaying motion of the hammer 2.

The keyboard device, which is constructed as described above, is preserved in the state shown in Fig. 1, when the key 1 is not depressed. That is, the hammer 2 rotates about the axis of the shaft 23 in the clockwise direction as viewed in FIG. 1 and FIG. 2, by the urging force of the position-recovering spring 34 and weighting load of the arm 36 and the hammer weight 37, to abut on the hammer-depressing projection 21 of the key and the stopper 16 of the keyboard chassis 4, whereby it is prevented from further rotation. As the hammer 2 rotates, the key 1 is lifted upward by the abutment 22 of the hammer 2 to rotate about the axis of the shaft hole 5 in the clockwise direction, until the stopper 17 of the key 1 abuts on the upper-most position-restricting stopper 19 to prevent the key 1 from further rotation. In this position of the key 1, the key switch 3 is spaced by the aforementioned predetermined distance from the switch-depressing portion 38 of the hammer 2, so that the key switch 3 is open or off.

When the key 1 is depressed from the above-described position, the key 1 rotates in the counterclockwise direction as viewed in FIG. 2, and the hammer-depressing projection 21 of the key 1 depresses the abutment 22 of the hammer 2 to move the hammer 2 downward against the urging force of the position-recovering spring 34 and the weighting load of the arm 36 and the hammer weight 37, causing the hammer 2 to rotate in the counter-clockwise direction. During rotation of the hammer 2, the switch-depressing portion 38 of the hammer 2 depresses the key switch 3 to turn it on at each of the two different positions thereof. The counterclockwise rotation of the key 1 is restricted by the lowermost position-restricting stopper 18 when the former abuts on the latter, while the rotation of the hammer 2 is restricted by the hammer stopper 15 when the former abuts on the latter.

Then, a unit part of a hammerless-type keyboard device according to a second embodiment of the invention will be described with reference to FIG. 5 and FIG. 6. The unit part of the hammerless-type keyboard device according to this embodiment comprises a key 1 having quite the same construction as the key 1 of the hammer-type keyboard device shown in FIG. 1 and FIG. 2, but it does not include a hammer 2, and component parts and elements associated therewith, such as the hammer shaft support member 24, the position-recovering spring 34, and the hammer stopper 15. Therefore, component parts and elements having quite the same constructions as those of the hammer-type keyboard device shown in FIG. 1 and FIG. 2 are designated by identical reference numerals, and detailed description thereof is omitted.

A switch printed-circuit board 41 of a key switch 3 is fixed to a keyboard chassis 4 by a screw 52 with a spacer 51 interposed therebetween, both of which are shorter than the spacer 39 and the screw 40 appearing in FIG. 1 and FIG. 2, so that the key switch 3 projects upward from a hole 53 formed through the keyboard chassis 4 to face the key-depressing projection 20 of the key 1. Thus, as compared with the key switch 3 of the hammer-type keyboard device described above, the key switch 3 of this embodiment is arranged at a location shifted upward, without being displaced in a longitudinal direction, i.e. either forward or backward. The switch printed-circuit board 41 has a peripheral portion held by a fixture 54 mounted on the keyboard chassis 4.

Further, a locking plate 55 fixes a key support member in the same manner as the locking plate 11 described in the first embodiment, but the locking plate 55 has a spring hook 56 extending upright from a rear end thereof. A position-recovering spring 58 is stretched between the spring hook 56 and a spring-holding portion 57 formed on a rear end of the key 1, for causing the key 1 to rotate in the clockwise direction as viewed in FIG. 5 and FIG. 6. In this connection, reference numeral 59 in FIG. 5 and Fig.6 designates a key weight for imparting inertia to the key 1.

Figure 5:
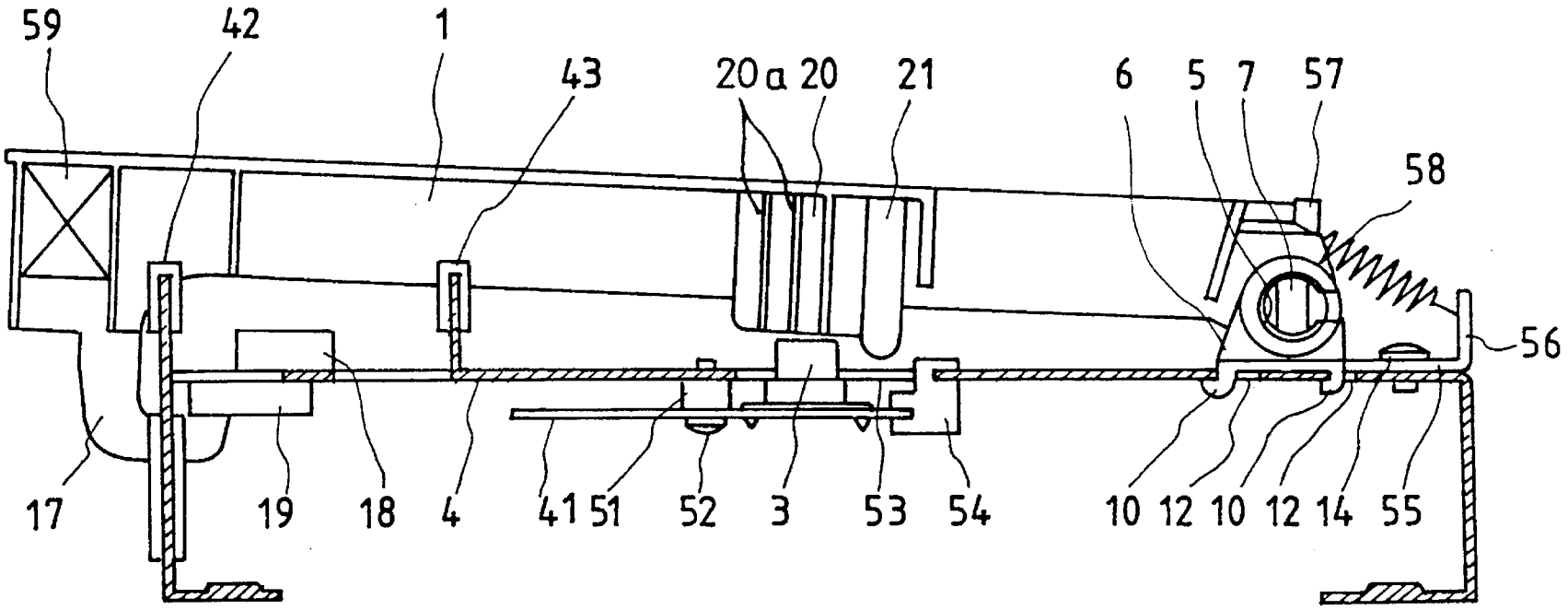
FIG. 5 is a cross-sectional view showing a unit part of a hammerless type, in its key-released state, of a keyboard device according to a second embodiment of the invention.
Figure 6:
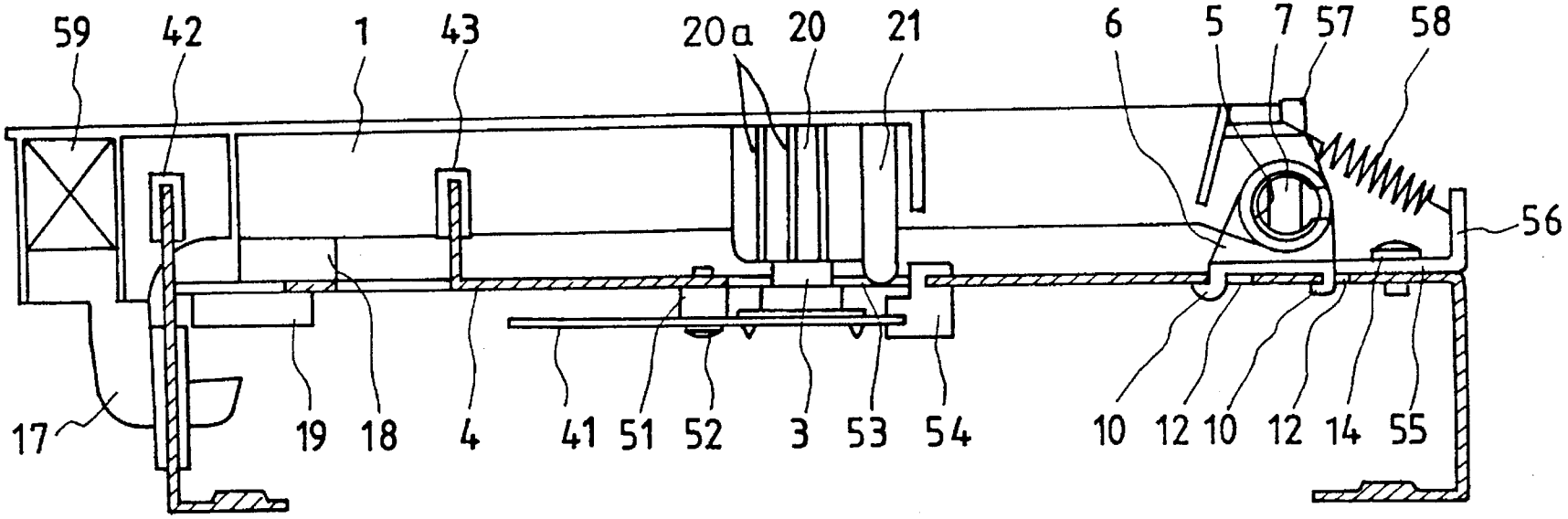
FIG. 6 is a cross-sectional view showing the unit part of the hammerless-type keyboard device of FIG. 5, in its key-depressed state.

According to the keyboard device of the second embodiment, which is constructed as described above, when the key 1 is not depressed, the key 1 is rotated in the clockwise direction as viewed in FIG. 5 and FIG. 6 to be brought into a position shown in FIG. 5 by the urging force of the position-recovering spring 58. When the key 1 is depressed from the above-described position, the key 1 rotates in the counterclockwise direction as viewed in the figures against the urging force of the position-recovering spring 58, to be brought into a position shown in FIG. 6. During rotation, the switch-depressing projection 20 directly depresses the key switch 3 to turn it on. In the meanwhile, the lower end portion of the hammer-depressing projection 21 moves downward through the hole 53 of the keyboard chassis 4, without preventing the key 1 from rotating.

As described heretofore, according to the keyboard device of the present invention, the switch-depressing projection 20 and the hammer-depressing projection 21 are provided on the key 1 at locations adjacent to each other. In the case of the hammerless type shown in FIG. 5 and FIG. 6, when the key I is depressed, the switch-depressing projection 20 directly depresses the key switch 3 to operate same, whereas in the case of the hammer type shown in FIG. 1 and FIG. 2, the hammer-depressing projection 21 depresses the abutment 22 of the hammer 2 to thereby operate the key switch 3 by way of the switch-depressing portion 38 of the hammer 2. Therefore, in the case of the hammer type, it is possible to operate the key switch 3 by way of the hammer 2, realizing an excellent feeling of a touch on the key which is more similar to that obtained from an acoustic piano.

Further, since the hammer 2 can be depressed at a point very close to the key switch 3, so that it is not necessary to displace the key switch 3 in a longitudinal direction, i.e. forward or backward depending on whether the hammer 2 is provided or not. This makes it possible to reduce manufacturing cost of the keyboard device owing to the compatibility of a key switch and fixture means associated therewith, as well as to minimize variation in the characteristic of depressing load of the key 1 dependent on whether the hammer 2 is provided or not. Further, since the hammer-depressing projection 21 depresses the hammer 2, the abutment 22 of the hammer 2 can be formed in a simple configuration, e.g. as one having a flat surface, which makes it possible to choose the type of cushion material attached to a contact surface of the hammer 2 as desired. Further, since the switch-depressing projection 20 and the hammer-depressing projection 21 are formed in one piece, the two projections reinforce with each other to increase the strength of each projection.

It is further understood that the present invention is not limited to preferred embodiments described above, and may be put into practice in various embodiments and variations. For instance, although in the above embodiments, the switch-depressing projection is formed with a plurality of laterally-projected fins, such fins may be omitted. Further, various changes and modifications may be made to the invention without departing from the spirit and scope thereof.

What is claimed is:

1. An abutment device operable with both a hammer-equipped keyboard and a hammerless keyboard, comprising:

a hammer-depressing portion for depressing a hammer when used in said hammer-equipped keyboard;

a switch-depressing portion for depressing a key switch when used in said hammerless keyboard; and wherein said hammer-depressing portion and said switch-depressing portion are arranged adjacent to each other, with said hammer-depressing portion extending to a level lower than a lower end of said switch-depressing portion.

2. An abutment device according to claim 1, wherein said hammer-depressing portion and said switch-depressing portion are formed in one piece with each other.

3. An abutment device according to claim 2, wherein said abutment device is provided for each key of said hammer-equipped keyboard or each key of said hammerless keyboard.

4. An abutment device according to claim 1, wherein said abutment device is provided for each key of said hammer-equipped keyboard or each key of said hammerless keyboard.

5. In a keyboard for an electronic musical instrument including a keyboard chassis, a plurality of keys rotatably mounted on said keyboard chassis, and a key switch disposed under each of said keys for detecting a key status of each of said keys, the improvement wherein each of said keys includes an abutment device capable of being used for both a hammer-equipped keyboard and a hammerless keyboard and disposed over said key switch, wherein said abutment device comprises a hammer-depressing portion for depressing a hammer when used in said hammer-equipped keyboard, and a switch-depressing portion for depressing said key switch when used in said hammerless keyboard, said hammer-depressing portion and said switch-depressing portion being arranged adjacent to each other, with said hammer-depressing portion extending to a level than a lower end of said switch-depressing portion.

6. A keyboard according to claim 5, wherein said hammer-depressing portion and said switch-depressing portion are formed in one piece with each other.

7. A keyboard according to claim 6, wherein said keyboard is said hammer-equipped keyboard having said hammer rotatably mounted on said keyboard chassis for each of said keys.

8. A keyboard according to claim 7, wherein said hammer has an abutment member for abutting said hammer-depressing portion of said abutment device, and a switch-depressing member arranged such that said switch-depressing member is located just above said key switch.

9. A keyboard according to claim 8, further including a spring for said hammer, wherein said abutment member of said hammer has a first spring-holding device for holding one end of said spring, said hammer being urged by said spring in a predetermined direction such that said abutment member of said hammer abuts on said hammer-depressing portion of said abutment device to urge said key in said predetermined direction.

10. A keyboard according to claim 9, further including a shaft provided for said hammer to allow said hammer to rotate about an axis of said shaft, and shaft support means fixed to said keyboard chassis for supporting said shaft, said shaft support means having a second spring-holding device for holding the other end of said spring.

11. A keyboard according to claim 6, wherein said keyboard is said hammerless keyboard.

* * * * *